United States Patent [19]

Dudley et al.

[11] Patent Number: 5,065,593

[45] Date of Patent: Nov. 19, 1991

[54] METHOD FOR CONTROLLING INDOOR COIL FREEZE-UP OF HEAT PUMPS AND AIR CONDITIONERS

[75] Inventors: Kevin F. Dudley, Cazenovia; Kevin B. Dunshee, Syracuse; Alan D. Abbott, Manlius, all of N.Y.

[73] Assignee: Electric Power Research Institute, Inc., Palo Alto, Calif.

[21] Appl. No.: 584,254

[22] Filed: Sep. 18, 1990

[51] Int. Cl.[5] ..... F25D 21/06

[52] U.S. Cl. ..... 62/182; 62/156; 62/227; 62/228.4; 62/186

[58] Field of Search ..... 62/180, 182, 186, 151, 62/215, 216, 227, 228.4, 228.5, 228.1, 156, 155, 282, 150

[56] References Cited

U.S. PATENT DOCUMENTS

| | | | |
|---|---|---|---|
| 3,559,422 | 2/1971 | Holzer | 62/228.4 X |
| 3,823,572 | 7/1974 | Cochran, Jr. | 62/160 |
| 4,027,497 | 6/1977 | Thurman | 62/156 |
| 4,132,086 | 1/1979 | Kountz | 62/228.5 X |
| 4,171,621 | 10/1979 | Trelease | 62/160 |
| 4,308,042 | 12/1981 | Ecker | 62/82 |
| 4,407,139 | 10/1983 | Ide et al. | 62/228.4 X |
| 4,507,932 | 4/1985 | Suzuki et al. | 62/227 X |

*Primary Examiner*—Harry B. Tanner

*Attorney, Agent, or Firm*—Wall and Roehrig

[57] ABSTRACT

A heat pump diagnostic and control system for controlling indoor coil freeze-up when in the cooling mode is provided. A low indoor coil temperature is sensed, the indoor fan speed is increased in steps up to a maximum to thaw the frost on the indoor coil. If this is not sufficient, the compressor speed is then reduced in steps until it is turned off and if necessary, it is held off until such time as the temperature sensor indicates thawing of the indoor coil of the heat exchanger. Diagnostic flow chart and control circuitry for accomplishing this control are disclosed.

7 Claims, 2 Drawing Sheets

METHOD FOR CONTROLLING INDOOR COIL FREEZE-UP OF HEAT PUMPS AND AIR CONDITIONERS

BACKGROUND OF THE INVENTION

This invention is directed to commercial or residential heat pump systems that provide heating or cooling of a comfort zone as required. More particularly, this invention is directed to a method and apparatus for controlling and preventing freeze-up of the indoor coil in a heat pump and air conditioner.

Heat pumps are often employed to provide heating or cooling, as needed, to a residential or commercial comfort zone, i.e., the interior of a residence, office, hospital or the like. Systems of this type can have a number of modes of operation such as air conditioning alone, space heating alone, and various combinations thereof. Under certain conditions, water vapor in the air can freeze on the indoor coil when the device is operated in the air conditioning mode and the coil temperature drops below normal operating temperatures. Formation of ice on the indoor coil leads to loss of cooling capacity and eventual shut down of the system due to low refrigerant pressure. The causes of this freezing up may include low air flow, low outdoor temperatures, loss of refrigerant, and low refrigerant flow.

OBJECTS AND SUMMARY OF THE INVENTION

Accordingly, it is an object of the present invention to provide a control system for preventing freeze-up of the indoor coil of a heat pump system.

It is another object of the present invention to provide a controller and logic sequence for managing the operation of a heat pump in the air conditioning mode to prevent formation of excessive frost on the indoor coil.

It is a further object of the present invention to provide a simplified timed step control sequence for maintaining the indoor coil temperature of a heat pump operating in air conditioning mode above the freezing point for water vapor in the comfort zone air being cooled.

These and other and further objects of the present invention are attained in an embodiment by sensing the coil temperature, the fan speed, and the compressor speed and by increasing the fan speed and decreasing the compressor speed when a low coil temperature is sensed, until the coil temperature rises above the desired predetermined point.

BRIEF DESCRIPTION OF THE DRAWING

Further objects of the invention, together with additional features contributing thereto and advantages accruing therefrom will be apparent from the following description of the invention which is shown in the accompanying drawings wherein.

DETAILED DESCRIPTION OF THE PREFERRED EMBODIMENT

Figure 1:
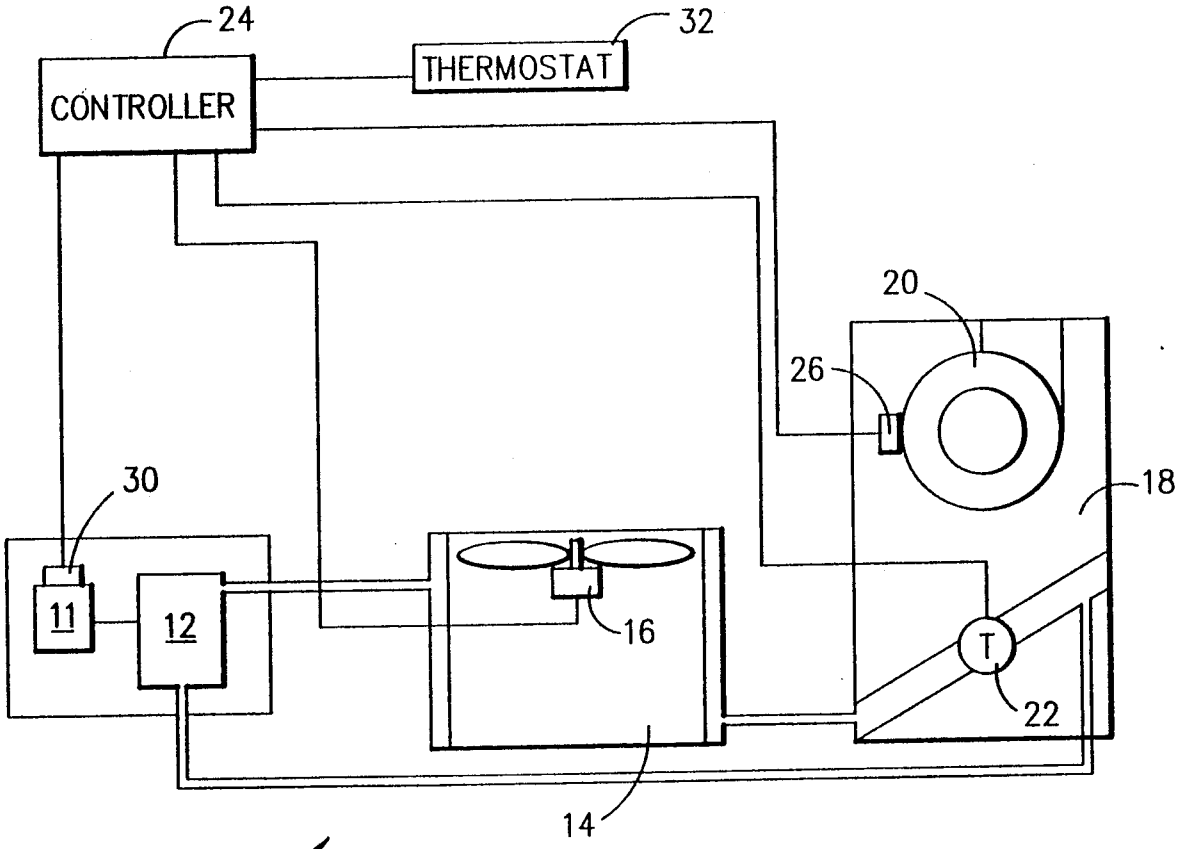
FIG. 1 is a block diagram of a typical heat pump system with the controller connected in accordance with the present invention.

Referring now to FIG. 1 there is shown in simplified block diagram form a basic heat pump 10 which includes a variable speed drive 11, a compressor 12, an outdoor coil shown in block diagram form at 14, an outdoor fan 16 operatively mounted adjacent the coil 14, an indoor coil 18 and an indoor fan 20 operatively associated with the coil 18. A coil temperature sensor 22 is mounted on the indoor coil 18. A controller 24 is mounted in any convenient location for controlling the heat pump 10. The temperature sensor 22 is connected to the controller 24 as is a speed sensor 26 mounted on the fan 20. A speed sensor 30 mounted on the variable speed drive 11 for the compressor 12 is also connected to the controller as is a thermostat 32 which is located in the comfort zone.

In normal operation, when the thermostat 32 is calling for cooling of the comfort zone, the heat pump 10 is operated in an air conditioning mode with the indoor coil providing cooling to the air drawn through the coil by fan 20 which air is blown into the comfort zone for cooling thereof. Heat is discharged through the outdoor coil 14 and fan 16 in the usual fashion with the compressor 12 being driven by the variable speed drive 11 to accomplish this operation. During air conditioning operation, if the sensor 22 senses a temperature below a predetermined value which would indicate that the coil 18 was starting to freeze up, this indication from the sensor 22 will be processed through the controller in accordance with the logic diagram of FIG. 2.

Figure 2:
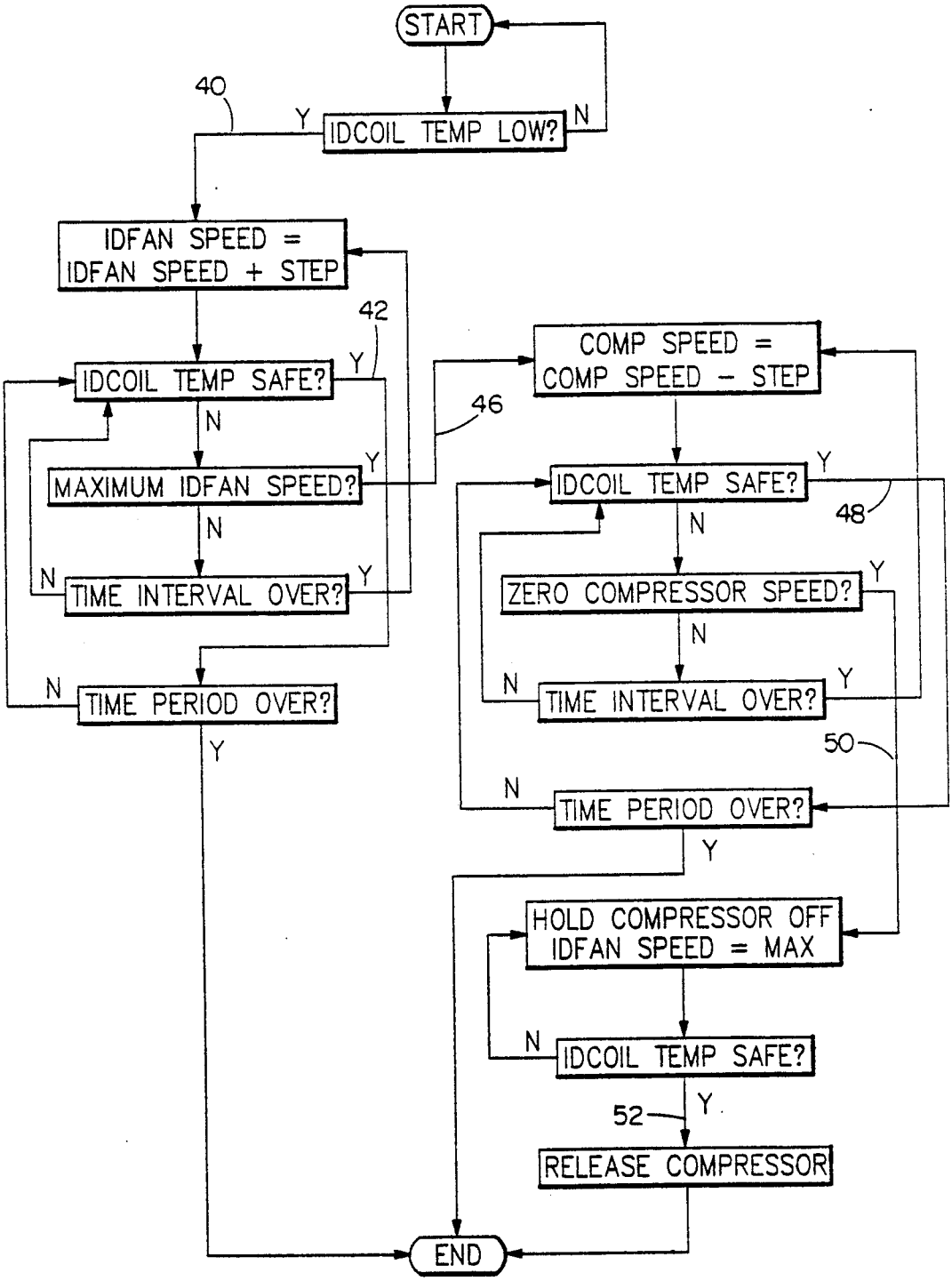
FIG. 2 is a flow chart of the logic system for the controller in accordance with the present invention.

As may be seen on the left-hand side of FIG. 2, if the indoor coil temperature is low, following the yes arrow 40, the controller increases the indoor fan speed control one step to speed up the indoor coil fan which increases the air flow over the coil. After a time interval, if a check of the indoor coil temperature indicates it has risen to a safe temperature, again following the yes arrow 42, a check is made to see if the preset time period has elapsed. The time period is set to ensure that the temperature of the coil rises sufficiently to permit normal operation again. Once that time period is over, the fan speed is reduced and the fan is returned to normal operation. If, on the other hand, the indoor coil temperature does not rise sufficiently, the "no" arrow 44 of the diagram is followed and the fan speed is increased step-by-step by the controller until the maximum fan speed has been reached. If the time intervals have been completed, the maximum fan speed has been reached, and the coil temperature indicated by sensor 22 has not increased sufficiently, then following the yes arrow 46 from maximum fan speed to the right-hand side of FIG. 2 the controller will start to reduce the compressor speed. The compressor speed routine is now followed reducing the compressor drive speed one step at a time. After the first reduction in compressor speed, if the indoor coil temperature is safe and following yes arrow 48, if the time interval is over, control of the compressor 12 is returned to thermostat 32. If, on the other hand, the indoor coil temperature still has not risen to a safe level, the compressor speed is reduced again, step-by-step until finally the compressor has reached a zero speed, or until the safe temperature is achieved at the end for the coil temperature.

As can be seen, in the right-hand side of the flow chart in FIG. 2, once the compressor speed has been reduced to zero, if the temperature still is not above a safe level, the compressor control moves to a holding mode following yes arrow 50 and the compressor is actually held in the off condition with the fan speed at maximum until the indoor coil temperature sensor indicates a safe temperature. At this point, following yes arrow 52, the compressor control is released back to the basic comfort zone thermostat 32 control. Also at this point, after the appropriate time interval has passed, the indoor fan speed will be returned to the normal thermostat 32 control. The heat pump 10 will then be back in normal operating condition.

By providing this simple, yet effective control system for the indoor fan and variable speed compressor during cooling operation of a heat pump, we have been able to provide a means for continuing the cooling of the comfort zone without abrupt changes in temperature, such as would occur with the conventional defrost type systems in which thawing of a frozen indoor coil is accomplished with a hot liquid. Also, by this mode of operation, a more efficient continuous type of control and operation can be achieved since corrective action can be taken early in the cycle of frost build-up on the indoor coil, as indicated by an incremental decrease in the temperature of the indoor coil sensor resulting in a more uniform control of the comfort zone temperature resulting in a more comfortable environment for the occupant.

While this invention has been explained with reference to the structure disclosed herein, it is not confined to the details as set forth and this application is intended to cover any modifications and changes as may come within the scope of the following claims.

What is claimed is:

1. In a heat pump system for heating or cooling a comfort zone having variable speed indoor and outdoor fans, indoor and outdoor coils and a variable speed compressor, the method of controlling indoor coil freeze up during cooling operation which comprises the steps of:

sensing the temperature of the indoor coil;

sensing the indoor fan speed and the compressor drive speed;

increasing the indoor fan speed when the indoor coil sensed temperature drops below a first predetermined point;

sensing the indoor coil temperature again;

reducing the compressor drive speed if the increasing fan speed has not raised the indoor coil temperature above a second predetermined point;

sensing the indoor coil temperature again;

shutting off the compressor if the reduced compressor drive speed has not raised the indoor coil temperature above the second predetermined point;

sensing the indoor coil temperature again;

returning the indoor fan and compressor drive speeds to normal when the indoor coil temperature rises above the second predetermined point.

2. The method according to claim 1 further including preventing a change in compressor speed until the fan speed has been increased to maximum and the indoor coil temperature remains below said second predetermined point.

3. The method of controlling the indoor coil temperature according to claim 1 wherein increasing the indoor fan speed is accomplished in a series of steps, each step being held for a predetermined time before the next step is initiated until the coil temperature rises above the second predetermined point or the fan speed reaches its maximum speed.

4. The method of controlling the indoor coil temperature according to claim 3 wherein decreasing the compressor drive speed is accomplished in a series of steps, each step being held for a predetermined time before the next step is initiated until the coil temperature rises above the second predetermined point or the compressor is stopped.

5. The method of controlling the indoor coil temperature according to claim 4 further including maintaining the compressor drive speed at zero until the indoor coil temperature rises above the second predetermined point.

6. In a heat pump for heating or cooling of a comfort zone having indoor and outdoor coils, variable speed fans operatively associated with each of said coils, a variable speed compressor connected to said coils, and a comfort zone thermostat, means for preventing freeze-up of the indoor coil comprising:

an indoor coil temperature sensor;

an indoor fan speed sensor;

a compressor speed sensor;

fan speed control means for increasing fan speed in incremental steps until maximum fan speed is reached or the indoor coil temperature rises to a predetermined value;

compressor speed control means for decreasing the compressor speed in incremental steps after maximum fan speed is achieved until the indoor coil temperature rises to a predetermined value;

a controller connected to each of the foregoing sensors, and to the comfort zone thermostat, having means for monitoring the indoor coil temperature and increasing, step by step the indoor fan speed and decreasing, step by step the compressor speed when said indoor coil temperature falls below a first predetermined value and fails to rise to a predetermined value at the increased fan speed.

7. A heat pump for heating or cooling a comfort zone having indoor and outdoor coils; variable speed fans operatively associated with each of said coils, a variable speed compressor, a comfort zone thermostat, and control means for preventing freeze up of the indoor coil comprising:

a programmable controller for varying the speed of the indoor fan and variable speed compressor;

an indoor coil temperature sensor connected to said controller;

an indoor fan speed sensor connected to said controller;

a compressor drive speed sensor connected to said controller; and said controller being programmed to:

increase fan speed step by step;

sense indoor coil temperature after each speed increase;

decrease compressor speed step by step after maximum fan speed is reached;

sense indoor coil temperature after each speed decrease;

return fan and compressor speeds to normal after the indoor coil temperature reaches a predetermined level for a predetermined length of time, after any step of speed change.

* * * * *